United States Patent [19]

Audeh

[11] 4,197,183

[45] Apr. 8, 1980

[54] PROCESSING OF TAR SANDS

[75] Inventor: Costandi A. Audeh, Princeton, N.J.

[73] Assignee: Mobil Oil Corporation, New York, N.Y.

[21] Appl. No.: 10,000

[22] Filed: Feb. 7, 1979

[51] Int. Cl.[2] ..... C10G 1/02; C10G 1/04

[52] U.S. Cl. ..... 208/11 LE; 48/197 R; 208/11 R

[58] Field of Search ..... 208/11 R, 11 LE

[56] References Cited

U.S. PATENT DOCUMENTS 3,118,741 1/1964 Faulk ..... 208/11 R

*Primary Examiner*—Herbert Levine

*Attorney, Agent, or Firm*—Charles A. Huggett; Carl D. Farnsworth

[57] ABSTRACT

Petroliferous material of tar sands is processed to recover both low and higher boiling distillate material in a sequential combination operation involving thermal distillation and solvent extraction. Residue of solvent extraction is gasified with hot sand product of gasification step used in the thermal distillation operation.

10 Claims, 1 Drawing Figure

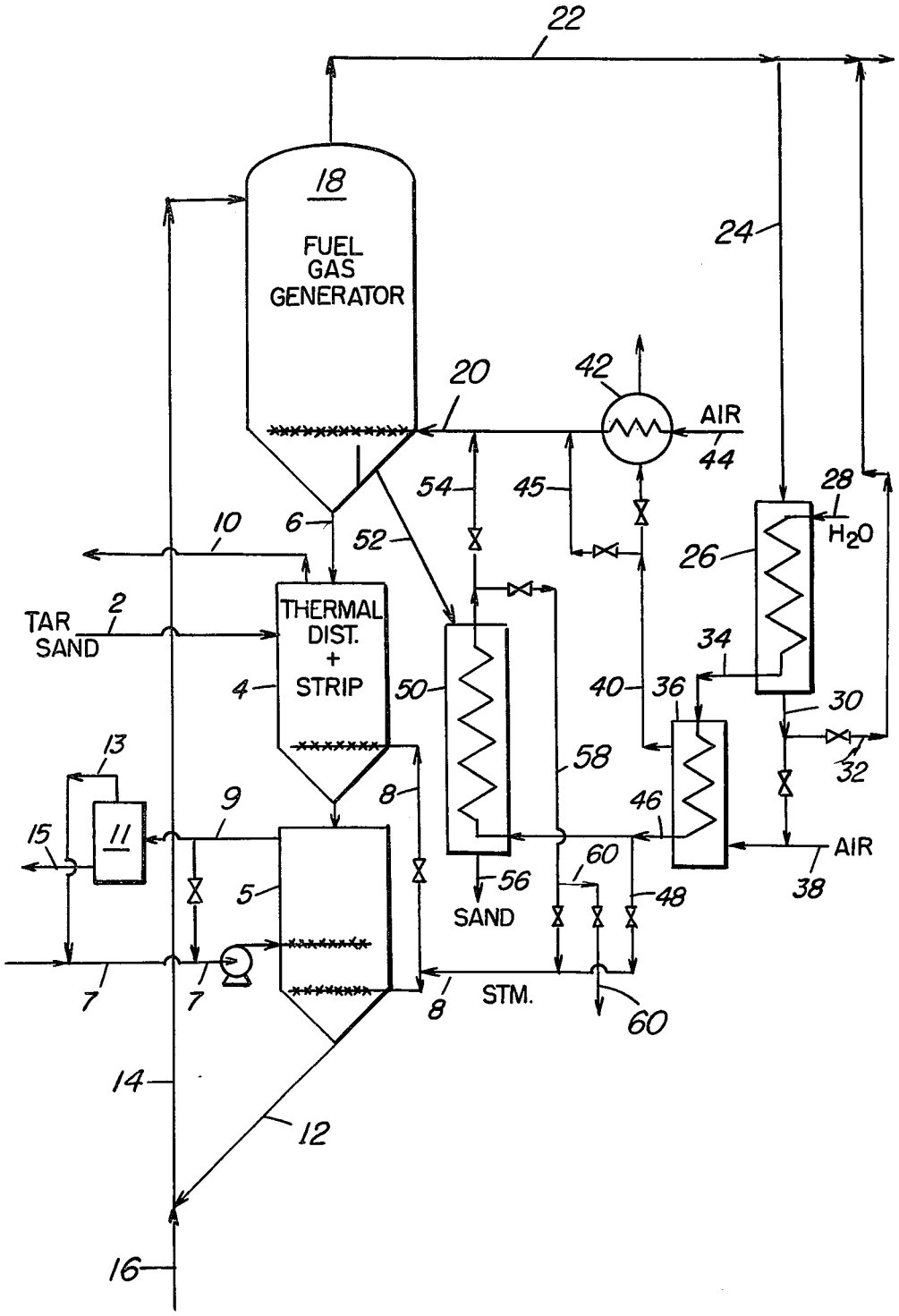
22
18
FUEL
GAS
GENERATOR
24
20
42
AIR
44
54
45
28
$H_2O$
10
6
52
26
TAR
SAND
2
THERMAL
DIST.
+
STRIP
34
4
50
40
36
30
13
58
32
9
8
46
15
11
AIR
60
5
56
48
38
SAND
7
7
8
STM.
60
14
12
16

PROCESSING OF TAR SANDS

BACKGROUND OF THE INVENTION

Tar sands, also known as oil sands and bituminous sands, are siliceous materials impregnated with petroliferous material convertible to petroleum products. The largest and most important deposits of the sands are the Athabasca sands found in northern Alberta, Canada. These sands underlay more than 1300 square miles at a depth of 0 to 2000 feet. The tar sands are primarily silica, closely associated with petroliferous material (heavy oily material) which varies from about 5 to about 21 percent by weight, with a typical content of 13 weight percent comprising sand. The oil is quite heavy, 6° to 8° API gravity and contains typically 4.5 percent sulfur and about 38 percent aromatics. The sands include clay and slit in quantities of from 1 to 50 weight percent (more usually 10 to 30 percent) and water in quantities of 1 to 10 percent by weight. The recovery of oily product from the tar sand has been pursued by a "cold water process," a "hot water process" as well as by retort methods which are akin to thermal cracking or pyrolysis techniques as used to process oil shale. A thermal method of recovering bitumen by direct retorting has been studied since 1940. In direct retorting, the raw oil sand is contacted with spent sand and fluidized by reactor off gas at a temperature above 900° F. The volatile products are flashed while 6–7 weight percent of coke (based on bitumen) is deposited via thermal cracking. The coked sand is burned off in a separate unit at 1200°–1400° F. and recirculated. The voluminous amount of spent sand needed, i.e., 5–10 parts per part of cold tar sand, for the process necessitates a very large retort volume per barrel of recoverable oil. Such methods obviously are expensive and of little interest. Serious waste heat and handling problems arise with this process.

The present invention is concerned with a combination process which embodies the technique of low temperature thermal distillation of bitumen in the presence of recycled hot sand particles acquired from a fuel gas generation zone processing a solvent extracted sand residue material of a solvent extraction operation.

The processing of sand comprising residue hydrocarbonaceous material recovered from a low temperature-severity distillation operation and subsequent solvent extraction thereof is accomplished under relatively high temperature conditions in the presence of a gas stream comprising oxygen and steam in desired proportions to produce particularly fuel gas. Thus, the reactions that occur in the gasification of the hydrocarbonaceous residue material include thermal cracking in combination with different other reactions, such as:

(1) $C+O_2 \rightarrow CO_2$
(2) $C+CO_2 \rightarrow 2CO$
(3) $C+H_2O \rightarrow CO+H_2$
(4) $C+2H_2 \rightarrow CH_4$
(5) $CO+H_2O \rightarrow CO_2+H_2$
(6) $H_2+\frac{1}{2}O_2 \rightarrow H_2O$ The oxidation of carbon, reaction (1), is highly exothermic. Gasification processes use partial oxidation of char with either air or oxygen to provide heat for the endothermic reactions of (2) and (3). These reactions comprising the gasification of char with $CO_2$ and the water gas reaction (3) are thermodynamically favored at temperatures above 1350° F. The methanation reaction (4) is highly exothermic and is thermodynamically favored at temperatures less than 1150° F. The water gas shift reaction (5) is mildly exothermic with favorable equilibrium below 1350° F. It is recognized by those skilled in the art that the composition of the produced fuel gas may be varied with pressure and temperature. That is, by raising the pressure and lowering the temperature, the methane yield may be increased. On the other hand, fuel gas of at least 120 BTU/SCF does not necessarily require the presence of large amounts of methane.

SUMMARY OF THE INVENTION

The present invention is concerned with a combination process for obtaining different hydrocarbon fractions from tar sands. The invention particularly relates to a combination process embodying the techniques of low temperature distillation under conditions minimizing cracking and gasification of a distilled oil product, the solvent extraction of the residual product of distillation to recover higher boiling hydrocarbons and the conversion of residual hydrocarbonaceous material of the solvent extraction step to produce fuel gas and generate transportable heat utilizable particularly in the extraction and the thermal distillation steps of the operation. The present invention is concerned with mixing high temperature solids comprising silica with tar sands in a thermal stripping operation restricted to materially limit any significant cracking of petroliferous material by maintaining the operating temperature restricted to within the range of about 700° F. to about 1000° F., depending upon the end point desired for the light hydrocarbon fraction recovered. Thus, the amount of hot spent sand recovered from a gasification step and required to distill the oil thermally is of a relatively low order of magnitude of no more than about 5 parts of spent hot sand per part of tar sand and preferably within the range of 0.6 to 2 parts per part of tar sand. This relatively low ratio of spent sand to fresh tar sand significantly reduces the solids handling problems of the operation while achieving a desired low boiling hydrocarbon product by thermal distillation. The low temperature-low severity thermal distillation step is operated to minimize cracking so that the concentration of higher boiling residual oily material on the sand is of desired boiling range. This oily sand residue comprising the higher boiling hydrocarbonaceous material is subjected to solvent extraction before the sand with residue carbonaceous material is used to generate 120 and higher BTU/SCF fuel gas, a very desirable product. The addition of steam and air during heating the sand with carbonaceous residue to a temperature above 1500° F. produces a suitable fuel gas product and its composition may be varied by using oxygen enriched gas to produce a high BTU gas. High temperature sand recovered from the gasification of carbonaceous residue and the fuel gas product of the combination operation are used to generate hot streams of air and steam used not only in the process but also to generate electricity in equipment not shown and external to the present combination.

The processing combination of this invention is unique in that the combination permits the separate recovery of selected boiling range low and higher boiling oily products of tar sands and the efficient generation of heat readily transported in the combination to achieve the results desired. The higher boiling oil product of the solvent extraction step is accomplished under particularly selected conditions. That is, the tar sand thermally distilled to obtain a desired low boiling distillate fraction having an end boiling point within the range of 700° F. to about 1000° F. is subjected to extraction with a low molecular weight organic solvent particularly suitable to selectively extract residual higher molecular weight nonasphaltic hydrocarbons remaining with the sand recovered from the thermal distillation operation. The solvent extraction operation desired is carried out under pressure and at least equal to or above the critical temperature of the particular solvent selected. Thus it is desired to particularly retrict any amount of asphaltic material recovered by the solvent extraction to a low order of magnitude. In this solvent extraction operation, the hot tar sands rcovered from the distillation operation serve as a major source of heat for maintaining the temperature of the solvent extraction operation. Heating of the solvent to achieve a desired extraction temperature is also contemplated in this operation.

The operating conditions and the solvent to solid or sand ratio of this operation will depend on the specific solvent utilized in the process and the hydrocarbons to be solvent recovered. It is contemplated operating the solvent extraction at a temperature within the range of 300°-375° C. (572°-707° F.), a pressure in the range of about 500 to 1000 psig and, depending upon the amount of high boiling nonasphaltic residue remaining with the tar sands following the distillation operation, the volume of solvent to volume of solids to be extracted will be at least 1 to 1 and may be as high as 3 to 1. It is contemplated effecting the extraction in a concurrent or a countercurrent operation. Thus a trickle bed type of extraction operation may be employed.

It is recognized that the composition of the sands will vary, depending upon source, and some will have more or less of the material that is separated by applicant's distillation operation and thus the amount of higher boiling material will also vary. Thus, where the amount of heavy oil recovered by the solvent is small, it may be more desirable to use such a low oil-solvent mixture in recycle until sufficient oil is collected by the solvent before separation efficiently in a flash separation or distillation operation.

Upon separation of the sand with asphaltic residue from the solvent extraction step, the solvent with heavy or the higher boiling portion of the hydrocarbons is separated as by flash separation or separation is made in a fractionating zone. The heavy oil fraction or portions thereof may be used to form lube oil materials by methods known in the art. Solvent recovered from the heavy oil is recycled to the solvent extraction step as herein provided. The heavy or high boiling hydrocarbons separated from the solvent may be hydrogenated, cracked and/or used as a feed to form lube oils with or without hydrodewaxing thereof in separate operations not shown. The sand residue of solvent extraction comprising asphaltic material and often referred to as insoluble organic matter is then passed to gasification for conversion as herein described.

To facilitate the recovery of solvent and the high boiling hydrocarbon components in the solvent extraction step, it is proposed to strip to solvent extracted sand by steam stripping before passing the sand with residual material to the gasification step. The stripped material may be passed with the raffinate of the solvent extraction step to one or more separation steps above identified for the recovery of solvent and stripping gas therefrom.

There are a number of different solvents that may be used with a high degree of success in the operation. Among the solvents that may be used are light hydrocarbon fractions collected by fractionation of the distillate product of thermal distillation, $CO_2$, propane, normally gaseous $C_2$ and $C_4$ olefins, light naphtha, gasoline boiling range hydrocarbons, and light kerosene with an end point of about 500° F. Other solvents that may be used include benzene, thiopene, methanol and polar compounds known in the art suitable for the purpose. Ideal solvents are those that have a fairly low critical temperature of 300° C. or less, are low boiling and are easily recoverable from the extract by flash separation and fractionation.

The combination process of the present invention is thermally efficient in the recovery of light hydrocarbons from tar sands, in the generation of transferable heat used in the process combination, in the separate recovery of heavy hydrocarbons useable for the manufacture of lubricants and in the gasification of residue carbonaceous material comprising asphaltic organic matter remaining with the sand following the thermal distillation and solvent extraction steps.

BRIEF DESCRIPTION OF THE DRAWING

The drawing is a diagrammatic arrangement of an apparatus for carrying out the invention process.

DISCUSSION OF SPECIFIC EMBODIMENT

Referring now to the drawing by way of example, tar sands comprising petroliferous material in the range of about 5 to 21 weight percent and more usually less than 15 percent by weight are charged to the processing combination of this invention by conduit 2 to a thermal distillation and stripping zone 4 maintained at a temperature within the range of about 600° to 850° F. and more usually in the range of 700° to 800° F. The pressure of stripper 4 may be in the range of atmospheric pressure up to about 100 pounds' pressure. More usually, the pressure is below 60 pounds. In stripping zone 4, sometimes referred to herein as a distillation zone, the introduced tar sands are mixed with hot sand particles in a ratio of less than 5 parts of recycled hot sand per part of tar sands introduced by conduit 6. The hot sand in conduit 6 may be directly or indirectly cooled to a desired temperature before passing to the lower temperature thermal distillation step. In addition, stripping steam introduced to the lower portion of the thermal distillation and stripping zone at an elevated temperature by conduit 8 is generally restricted to a range of 5 to 10 percent by weight of the hydrocarbon charged. Thus, the temperature profile desired within the thermal distillation zone is maintained particularly by the hot sand charged thereto in combination with stripping steam when charged to the bottom of the stripper at a desired temperature restricting the recovery of light distillate. The hydrocarbon product of distillation is recovered from the upper portion of the distillation zone by conduit 10. Generally speaking, it is preferred to recover by the distillation step all of the relatively light hydrocarbon material boiling below about 700° F. and recoverable in the absence of thermal cracking and particularly below incipient cracking. However, if desired, the end point of the oil recovered by the distillation step may be up to about 950° F. A sand product comprising heavy hydrocarbonaceous material comprising asphaltic type organic material is passed from distillation zone 4 to a solvent extraction zone 5 for contact with a light solvent material charged by conduit 7. Solvent extracted hydrocarbons are removed from zone 5 by conduit 9 for passage to a product recovery zone 11 such as a flash separation zone wherein the solvent is separated from the heavier hydrocarbon extracted. Recovered solvent is recycled to the process by conduit 13. Separated heavy hydrocarbons are removed by conduit 15 for further processing as discussed herein. It will be recognized by those skilled in the art that other known methods and means may be employed for separating the raffinate of the solvent extraction step into desired components for the recovery of solvent used in the process and particularly desired product hydrocarbons. A sand product comprising primarily asphaltic type of residual material or carbonaceous material is withdrawn from the bottom of solvent extraction zone 5 by conduit 12 and charged to a lift conduit 14. A suitable lift gas such as flue gas, steam or fuel gas products of the fuel gas generator or gaseous components of the combination operation and combinations thereof may be used as lift gas and charged to the bottom of lift conduit or riser 14 by conduit 16. The lift gas employed is preferably at an elevated temperature suitable for conveying as a suspension the solids comprising sand with asphaltic type of residual carbonaceous material obtained from the solvent extraction operation. The lift gas forms a suspension with the solids and conveys the solids through the riser for discharge in the upper portion of a fuel gas generator 18.

In gas generator 18, the solids which are primarily silica with asphaltic carbonaceous residue of solvent extraction pass generally downward countercurrent to a gaseous mixture of steam and air introduced at an elevated temperature within the range of 1000° F. to about 2000° F. by conduit 20 to the lower portion of gas generator 18. Gas generator 18 is operated at a temperature within the range of about 1500° F. to about 2200° F. It is intended that the gas generator be operated at a pressure within the range of atmospheric up to several hundred pounds. A particularly desirable pressure range of about 60 pounds up to about 100 pounds and under conditions producing 120 and higher BTU fuel gas suitable for use in power generation is most useful. The fuel gas will comprise a mixture of hydrogen, carbon monoxide, carbon dioxide and methane. In generator 18, the solids passed thereto and comprising particles of silica with carbonaceous residual material are heated to an elevated temperature within the range of 1500° to 2000° F. by combustion of the carbonaceous material with air or an oxygen enriched gas to form CO and $CO_2$. The presence of added steam promotes other known reactions hereinbefore identified and contributes to forming a fuel gas composition of at least 120 BTU/SCF. A portion of the sand particles heated in gas generator 18 to an elevated temperature of at least 1000° F. is withdrawn as by conduit 6 for passage to and use in thermal stripping zone 4, as discussed above. Another portion of the hot sand particles is recovered and withdrawn by conduit 52 for use as hereinafter discussed.

The fuel gas generated in zone 18 by conversion of carbonaceous residue is recovered therefrom by conduit 22 at an elevated temperature within the range of about 1500° to about 2000° F. All or a portion of this recovered hot fuel gas is passed by conduit 24 to indirect heat exchanger 26. In exchanger 26, the hot fuel gas indirectly preheats water charged thereto by conduit 28. Cooled fuel gas is recovered from exchanger 26 by conduit 30 and a portion thereof is passed by conduit 32 for recovery and/or admixture with fuel gas in conduit 22. The water preheated in heat exchanger 26 is recovered and passed by conduit 34 to a second heat exchange zone 36 wherein further heating of the preheated water is accomplished by combustion products of burning fuel gas in zone 36. That is, a portion of the fuel gas in conduit 30 is mixed with air or other suitable oxygen containing gas in conduit 38 and combusted in indirect heat exchanger 36. Gaseous products of combustion are recovered by conduit 40 from zone 36 and may be used in indirect heat exchanger 42 to preheat air charged by conduit 44 thereto or gaseous products in 40 may be passed by conduit 45 for direct mixing with air in conduit 20. The preheated air may be further heated by partial combustion in a zone not shown and/or hot combustion products may be combined with additional oxygen containing gas such as air and charged to the bottom portion of generator 18 by conduit 20. A steam product is recovered from fired heat exchanger 36 by conduit 46 at an elevated pressure within the range of 500 to 1000 psig.

This steam product in conduit 46 may be charged directly to the lower portion of stripping zone 4 by conduit 48 communicating with conduit 8 or further heating of all or a portion of this steam stream may be accomplished as follows. That is, steam in conduit 46 may be passed to zone 50 to which hot solids are passed by conduit 52 from gas generator 18. In zone 50, the steam in conduit 46 directly or indirectly contacts the hot solids and is heated to an elevated temperature sufficient to be passed directly by conduit 54 to the lower portion of generator 18 in combination with air preheated as above described. Sand thus cooled is withdrawn from zone 50 by conduit 56. It is contemplated using partially cooled sand recovered from zone 50 to preheat air charged to either one or both of zone 18 or zone 36. It is also contemplated passing a portion of the superheated steam recovered from zone 50 by conduit 54 to the stripper section of zone 4 and zone 5 by conduit 58 communicating between conduits 54 and 8. On the other hand, all or a portion of the steam in conduit 58 may be passed by conduit 60 to a steam turbine not shown for electric power generation.

The processing combination of this invention is unusually novel in the many different arrangements of heat recovery and the utilization of that recovered heat in the operation. Furthermore, the low temperature distillation operation of zone 4 in combination with solvent extraction in zone 5 permits a substantial reduction in solids handling and a more complete recovery of light and heavy hydrocarbon product absent asphaltic materials closely resembling straight run petroleum products suitable for use as feed material to hydrotreating, hydrocracking, fluid catalytic cracking, and/or portions of the product recovered may be hydrogenated and desulfurized in downstream operations not shown to produce particularly No. 2 fuel oil. Thus, the combination operation of this invention substantially maximizes the recovery of valuable hydrocarbon and transferable energy from a heretofore unpopular tar sand charge material by particularly producing light and heavy fuel oils, a high BTU gas product, electric power and heat transport within the combination process contributing substantially to its operating efficiency.

It is recognized that numerous variations may be made on either one or both of the fuel gas generator or the thermal distillation zone above specifically discussed and on the process arrangement represented by the drawing and such variations may be made without departing from the scope of the invention. The drawing may be rearranged to place the solvent extraction step alone or in combination with the thermal distillation zone above the gas generator. There are certain inherent advantages associated with flowing very hot solids as well as cooler solids with carbonaceous material thereon by a standpipe or a lift conduit or riser means. However, in the event that the solids recovered from the solvent extraction step are somewhat tacky because of residual asphaltic material, it is contemplated adding additional hot solids to the tacky mixture before conveying the tacky solids through either a standpipe or a riser transfer conduit means. For example, some of the sand in conduit 56 still at a relatively high temperature or higher temperature solids in conduit 52 may be mixed with the solids in conduit 12 for transfer in riser 14.

In a very specific embodiment, it is contemplated recovering hydrocarbon products in the tar sands under the following operating conditions identified particularly with the thermal distillation operation. Remaining residual hydrocarbons other than asphaltic organic material are thereafter removed by solvent extraction.

| | | % Volume to Recovered Product | % Volume to Hydrocarbons in Tar Sand |
|---|---|---|---|
| 1. In the thermal distillation section of the process, for a 650° F. process temperature, a product containing hydrocarbons boiling up to 690° F. is recovered: | | | |
| Gasoline | OP-392° F. | 8.1 | 2.0 |
| Kerosine | 392-527 | 38.1 | 9.4 |
| Light Gas Oil | 527-690 | 53.8 | 13.3 |
| 2. Similarly for 800°; | | | |
| Gasoline | OP-392° F. | 4.2 | 2.0 |
| Kerosine | 392-527 | 19.7 | 9.4 |
| Light Gas Oil | 527-690 | 27.9 | 13.3 |
| Heavy Gas Oil | (690-790 | 27.1 | 12.9 |
| | (790-850 | 21.0 | 10.0 |
| 3. And for 950° F.: | | | |
| Gasoline | OP-392° f. | 3.2 | 2.0 |
| Kerosine | 392-527 | 15.0 | 9.4 |
| Light Gas Oil | 527-690 | 21.3 | 13.3 |
| | (690-790 | 20.6 | 12.9 |
| Heavy Gas Oil | (790-850 | 16.0 | 10.0 |
| | (850-1000 | 23.8 | 14.9 |

Having thus generally described the method and process of this invention and specifically described a processing arrangement in support thereof, it is to be understood that variations may be made thereon without departing from the spirit and scope thereof as defined by the following claims.

I claim:

1. In a process for upgrading tar sands by the combination of thermal distillation to recover a distillate material boiling below about 850° F. and gasification of residue hydrocarbonaceous material remaining with the sand recovered from the thermal distillation operation to produce fuel gas and high temperature streams of sand particles, air and steam transferable for use in the process combination, the improvement which comprises effecting thermal distillation of tar sand admixed with hot sand particles obtained from said gasification step under conditions to obtain a hydrocarbon product of end boiling point within the range of 650° F. to about 1000° F., passing sand with residual oily higher boiling hydrocarbon material from said thermal distillation operation to a solvent extraction operation maintained under conditions to remove said higher boiling hydrocarbons other than asphaltic type organic material by solvent extraction, passing sand with asphaltic type organic material separated from solvent extracted material to said gasification zone maintained under conditions to produce a fuel gas product and hot sand particles, recovering solvent with extracted higher boiling hydrocarbons and separating to recover solvent from said higher boiling hydrocarbons, and using the hot fuel gas product and sand obtained from said gasification operation to provide heat to the above identified combination of processing steps.

2. The process of claim 1 wherein the end point of the hydrocarbon material recovered by thermal distillation is about 690° F.

3. The process of claim 1 wherein the end point of the hydrocarbon material recovered by thermal distillation is about 800° F.

4. The process of claim 1 wherein the end point of the hydrocarbon material recovered by thermal distillation is about 950° F.

5. The process of claim 2 wherein light gas oil and lower boiling hydrocarbons including kerosine and gasoline are recovered by said thermal distillation and recovered higher boiling hydrocarbons by solvent extraction are used to produce lube oils.

6. The process of claim 2 wherein material higher boiling than a heavy gas oil is recovered by solvent extraction.

7. The process of claim 1 wherein hot sand particles recovered from the gasification step are partially cooled prior to charging to the thermal distillation operation.

8. The process of claim 1 wherein sand particles comprising an asphaltic residue are admixed with hot particles of sand from said gasification step before transfer to said gasification step by a riser or by a standpipe.

9. The process of claim 1 wherein the solvent with hydrocarbon extract is recycled through the solvent extraction zone more than once before separation of solvent from hydrocarbon extract.

10. The process of claim 1 wherein the solvent extraction zone is positioned above the gasification zone and the gasification zone is beneath the thermal distillation zone.

* * * * *